United States Patent [19]

Widell et al.

[11] Patent Number: 4,494,808

[45] Date of Patent: Jan. 22, 1985

[54] ELECTRICAL COLLECTOR RAIL WITH CONNECTABLE ADAPTER

[76] Inventors: Harald Widell, Kalendervägen 25; Jan Widell, Augustivägen 11; Nils-Åke Bergman, Junivägen 24, all of S-352 47 Växjö, Sweden

[21] Appl. No.: 448,803

[22] Filed: Dec. 10, 1982

[30] Foreign Application Priority Data

Dec. 17, 1981 [SE] Sweden ..... 8107582
Mar. 29, 1982 [DE] Fed. Rep. of Germany ... 8208908[U]

[51] Int. Cl.[3] ..... H01R 9/00
[52] U.S. Cl. ..... 339/21 R; 339/22 B; 339/88 R
[58] Field of Search ..... 339/21 R, 21 S, 22 R, 339/22 B, 88, 20

[56] References Cited

U.S. PATENT DOCUMENTS 3,980,368 9/1976 Fremont ..... 339/88 R

FOREIGN PATENT DOCUMENTS 2423898 12/1979 France ..... 339/21 R

*Primary Examiner*—John McQuade
*Assistant Examiner*—Paula Austin
*Attorney, Agent, or Firm*—Browdy and Neimark

[57] ABSTRACT

Electrical current rail 1, which may function as collector rail for power distribution, houses phase conductors 35, 36 and zero-conductor 37, with which adaptor 2 is intended to come into contact via plugs (86, 98), which are connected to a respective phase conductor plug and zero-conductor plug (not shown) intended to provide electrical connection with said adapter 2. Said phase conductors 35, 36 are provided in the interior space 16 behind the front 7, 8 of the rail and are accessible only in a direction from the inside of the rear side 4 of the rail. The front 7, 8 is divided by an opening 11 for reception of an insertion part 49, 50 of the adapter 2 provided with a contact beam 78, which is both pivotable and movable backwards and forwards into contact with said phase conductors and out of contact with the same by means, e.g. screw 69, accessible on the front of the adapter 2.

13 Claims, 12 Drawing Figures

Fig. 7
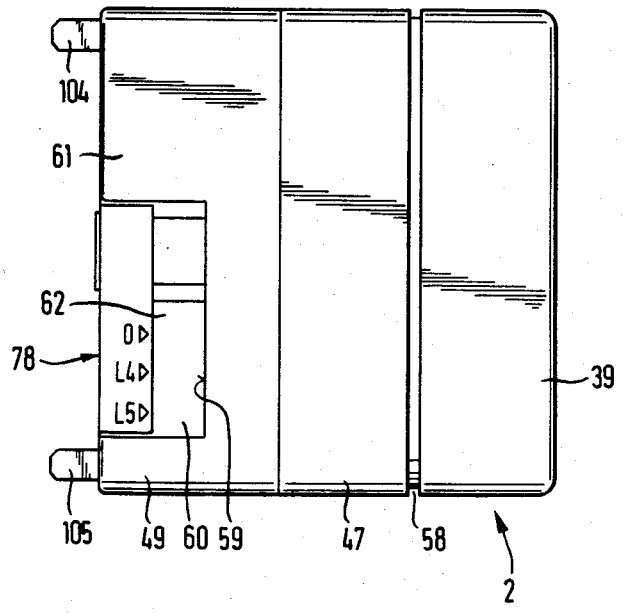
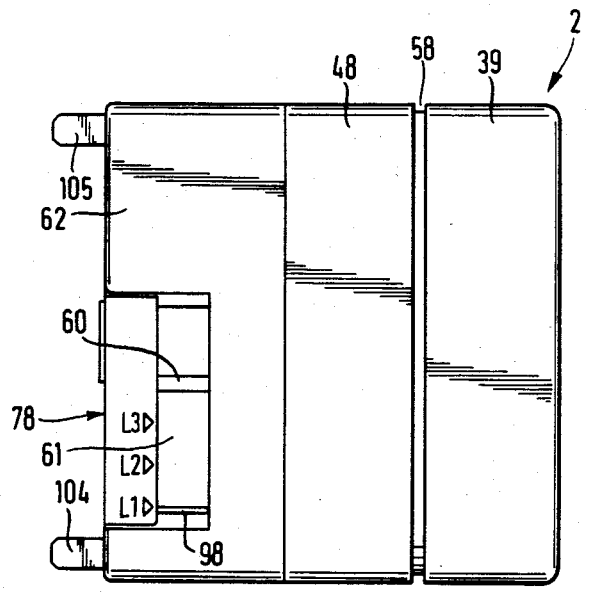
Fig. 8

ELECTRICAL COLLECTOR RAIL WITH CONNECTABLE ADAPTER

TECHNICAL FIELD

This invention concerns a rail for supplying rooms with electrical current and telephone connections and also other possible connections and an adapter connectable thereto.

BACKGROUND ART

It is already known and still very usual in, for example, dwelling-houses, offices and administration buildings to provide an electrical power system as a draw-in system or an exposed wiring as a so-called visible mounting. Such a system is inflexible because it uses fixed output points, which are predetermined before the relevant building is constructed. Changes at a later date are very often impossible or extremely difficult to achieve, they cost a considerable amount in terms of money and time and the result is often not aesthetically pleasing.

The disadvantages of these kinds of installations led to provision of so-called wiring channels or contact rails. Wiring channels are normally located visibly on walls and run horizontally along the walls at a height generally level with a top of a desk. Electrical cables in such channels are connectable, for example, to plugs, the location of which can be determined at a later date. Once determined, however, this location is fixed because to change a plug's location new wiring of cables would be required. Contact rails, on the other hand, have the advantage that sheathed cables are replaced by blank conductors conducting along their entire length. Accordingly, a connection can be made at any place along such contact rails without change of the phases or change in the plugs and current consuming elements such as light emitting armatures etc. can be directly connected thereto.

This much needed flexibility of connections at such contact rails was however, made at the cost of safety, becauae the connectors carrying current are easily accessible and children in particular may risk serious injury by touching them inadvertently or otherwise. Normally, therefore, there are strict provisions relating to minimum height of such installations (2.3 meters) and/or for the use of low voltage or low current supply.

These requirements which are, of course, fully justified for safety reasons also severely limit the use of known contact rails.

A typical contact rail is of U-shape with an opening directed downwardly and laterally to the middle of a room and electrical conductors embedded at the inner side of a limb of the U-profile. A typical example of such a contact rail is shown and described in Swedish patent application 71-6528. In this case there is no direct danger of electric shock, as the electric conductors are embedded relatively deeply within electrically isolating material. However, there is still a risk that children may attempt to plug-in items and receive a shock as the space adjacent the voltage carrying conductors can be directly touched through the opening of the contact rail.

It is an object of the present invention to provide a new rail for the supply of electrical current and telephone and the like connections which is designed to be so safe that risk of electric shock or plug-in are reduced to an absolute minimum, so that such a current rail may be safely used as an output rail for high current supply and can be mounted at any height. A further object of the present invention is to enable different phase selections and to do this in a simple safe and reliable manner. Furthermore an inventive rail, although having technical advantages should have a good design, should be relatively cheap to manufacture and should be mounted so as to be changed in a simple quick and safe way, for example in order to be extended and to be mounted around corners and through recesses.

DISCLOSURE OF INVENTION

The object is achieved in accordance with the present invention by provision of an electrical collector rail with a connectable adapter wherein said rail houses a number of conductors with which the adapter is intended to be connected via plugs or the like characterized in that the rail is substantially C-shaped in cross-section and receives the adapter via an opening in its front wall, in that at least a part of the conductors is situated behind said front wall, and in that the adapter is provided with an extendable contact beam which is intended to be flush with an insertion part of the adapter when the latter is inserted and removed and which is extendable within the rail by a pivoting operation and movable forwards into contact with said conductors and backwards out of contact with said conductors via means which are accessible from outside the rail.

A current rail according to the invention can be used in an advantageous manner as an alternative to and to replace conventional wiring channels or as a complement to such ones, and TV or telephone cables, etc. may also be located within the rail. The current rail according to the invention can, of course, be designed and developed in such a way that a separate space for wiring TV and telephone cables, etc. is provided. The inventive rail may be considered to be so safe that it can be directly offered as a standard with a three-phase-group and two-phase-groups. Alternatively three one-phase-groups can be provided. One can chose between direct connection of all conceivable electrical apparatus and elements and connection by means of an outlet socket, whereby all of these kinds of connections are by way of an adapter according to the invention. The device of the invention is also considered to be splash-proof and drip-tight. Connections and/or extension may be made to the rail of the invention without switching off the voltage in the previously installed rail. The ground wire is located asymmetrically and, preferably, other parts of the adapter are asymmetric so that the adapter cannot be connected to the wrong conductor.

Each adapter preferably has its own built-in automatically acting fuse, which can also be used as a switch. By automatically fusing each of the adapters a mistake originating in one of the apparatus connected to the current rail does not influence the remaining connected apparatus. Each adapter preferably has a built-in phase selector so that an undesired connection of more than one phase to a one-phase-connector is impossible. Adapters of any kind can, of course, be mounted and dismounted along the entire length of the inventive current rail without the need to switch off the rail voltage so that any other attached apparatus does not have to be disturbed. Finally, it should be pointed out that a preferable style of a connection device according to the invention has the advantage that tensile stress does not debase the contact function or has any tendency thereto as it is the case with conventional systems. In other words, there is a guaranteed safety and reliability of contact at press load or a load along an inclined line of application.

BRIEF DESCRIPTION OF DRAWINGS

The invention will be described further, by way of example with reference to the accompanying drawings, in which:

FIG. 7 is a view of the adapter shown in FIG. 4, from below;

FIG. 8 is a plan view of the adapter shown in FIG. 4;

DETAILED DESCRIPTION OF INVENTION

Figure 1:
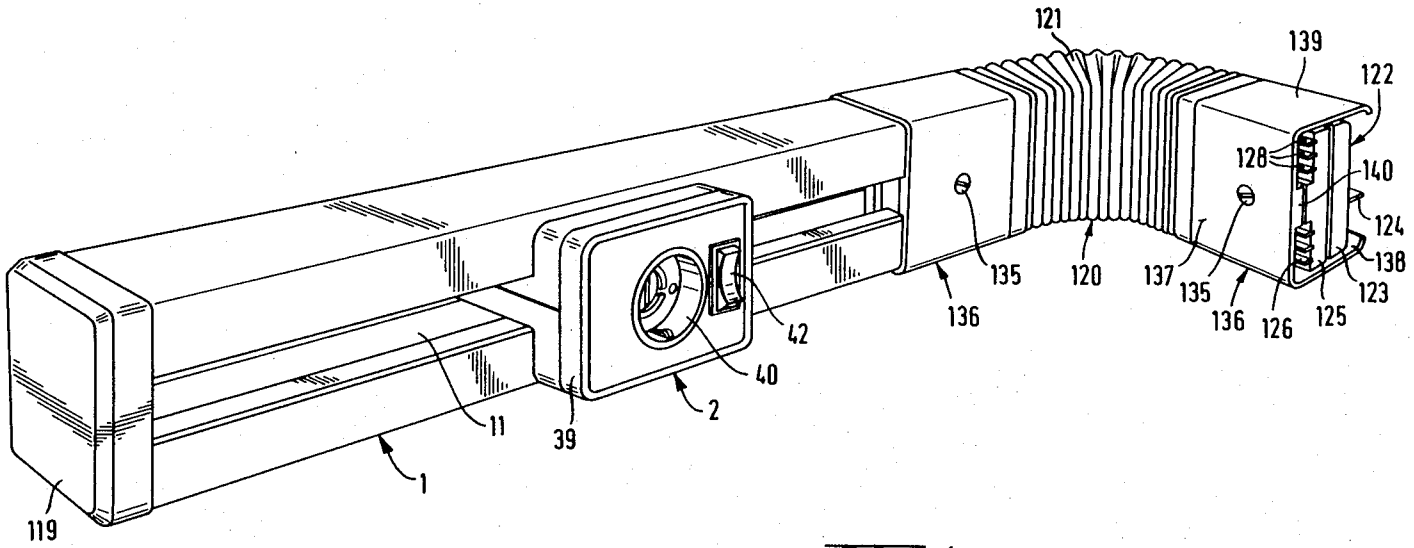
FIG. 1 is a perspective view of an embodiment of the current rail and adapter of the present invention, including an angle piece.

FIG. 1 illustrates the main components of the device of the invention, namely an electrical collector or current rail 1, adapter 2 for connection of electrical apparatus and other devices, two jointing devices 122 each with a lid 136 and an angle piece 120 with a concertina-like covering 121 and a cover plate 119 also used as an end part of the current rail.

The current rail 1 (FIG. 2) comprises a hollow C-shaped body 3 of rectangular cross-section, one longitudinal side of which is designed as a rear wall 4 with adjacent side walls 5 and 6, which in turn lead to front walls 7 and 8. The latter extend in the direction of the rear wall 4 and form walls 9 and 10 limiting an opening 11. The free edges of the opening walls 9 and 10 end in hook profiles 12, 13 respectively, which are directed towards the side walls 5, 6 and face hook profiles 14, 15 on the inner sides of the side walls.

Figure 2:
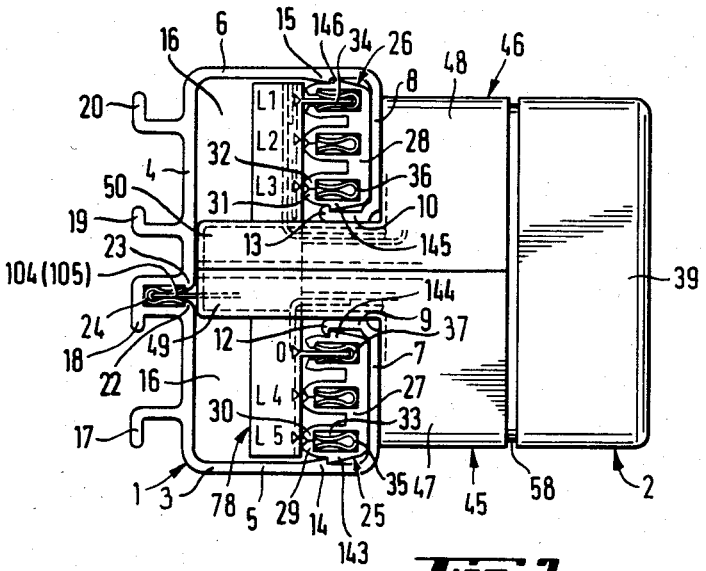
FIG. 2 is a cross-section through one embodiment of the current rail of the present invention and one embodiment of an adapter of the present invention, shown in end view, connected thereto.

The rail encloses a space 16 (FIG. 2). Mounting profiles 17, 20 extend from the outer side of the rear wall 4 spaced apart from each other and may be utilized for wall mounting of the current rail. Further mounting profiles 18, 19 for mounting the current rail on the ceiling are provided between the aforesaid profiles 17, 20. These pairs of mounting profiles 17, 20 and 18, 19 have flanges directed away from each other and provide for the mounting of the rail on a bracket or other fixation means.

One inner mounting profile 18 has a groove 21 opening into the space 16. Hook profiles 22, 23 are located at the transition from the groove 21 to the space 16 and are used to lock an earth wire 24, which is designed as a U-shaped terminal strip having inwardly curved limbs providing a safe, elastic contact pressure therebetween.

The regions between the hook profiles 12 and 13, the opening walls 9 and 10, the front walls 7 and 8, the side walls 5 and 6 and the hook profiles 14 and 15 respectively accommodate respective insulating strips 25 and 26 made from suitable plastics material with given elastic properties. Each insulating strip consists of a base 27, 28 contacting the respective front wall 7, 8 and having lips 29, 30 and 31, 32 respectively arranged in pairs and directed towards the central space 16 to define generally rectangular channels 33 and 34 respectively for housing conductors 35 and 36 respectively or an earth wire 37. These conductors 35, 36 have the same shape as the earth wire 24. Each insulating strip 25, 26 has outwardly projecting shoulders 143, 144 and 145, 146 respectively in order to snap in behind the hook profiles 12, 14 and 13, 15 respectively. These lie adjacent each other in pairs with curved elastic free ends forming wedge-shaped input openings from the central space 16 which is normally not in connection with the channels and the conductors 35, 36, 37. Thus, these conductors 35, 36, 37 are completely protected against contact and are splash-proof and drip-proof. When electric contacts (discussed below) are pushed with a given force into the openings of the insulating strips the closing power of the respective lips of the insulating strips can be overcome and the contacts are able to enter and make contact with the conductors.

When the adapter 2 is inserted into the current rail 1 in a manner to be discussed below, the contact lips and the conductors are deformed by the inserted contacts.

The adapter 2, shown in FIG. 1, is designed as a power outlet into which a power plug for the connection of any electric apparatus can be inserted. The adapter 2 can of course, also be used for direct connection of electric apparatus since the power outlet is designed as a suitable and known adapter for an electric cable or the like. The adapter 2 will be described in detail in connection with FIGS. 4, 5 and 6 of the drawings.

The front 39 (FIGS. 1, 4, 5, 6) of the adapter 2 is designed as a generally closed, flat rectangular tray-shaped body, which is open from the rear side. In the present case the adapter 2 is designed as a power outlet and the front side therefore had a deepened power outlet insert 40 of known type. At one side of the front 39 there is a recess 41 (FIG. 6) for inserting a switch, e.g. toggle switch 42 embodying a fuse. The switch 42 and the fuse can be formed as one unit and may be inserted into the recess 41 from the front side of the adapter 2 in the direction of an arrow 42' (FIG. 6) and may there be snapped in. To accomplish this known hook profiles (not shown in the drawings) are provided at a suitable place behind the front of the adaptor. The switch 42 with the incorporated fuse is provided with laterally extending flat connectors 43, 44.

Behind the front 39 are located a lower housing part 45 and an upper housing part 46. These two parts 45, 46 are designed so as to be almost symmetric so that only one item has to be made. The two parts are halves 47, 48 of the housing and include insertion parts 49, 50 formed like ledges as regions of the adapter 2 of reduced thickness which correspond exactly to the opening 11 of the rail (FIG. 1). The lower part 45 may have upwardly facing lateral grooves 51, 52 into which the free edges of the upper part 46 can be inserted. Both parts 47, 48 of the housing may have suitable guides or sleeves, 53 and 54 respectively in their corners for reception of screws 55 which may be screwed into screwed holders inside the adapter 2 behind the front 39. In this way the front 39 holds together the housing parts. The latter are also held together by transversely orientated screws 57 located in guides (not shown) in the insertion parts 49, 50. Between the front 39 and the other housing parts there is a groove 58 running around the housing mainly for aesthetic reasons. At the rear or free end of each of the insertion parts 49 and 50 respectively there is a rear recess 59 and 60 respectively open from above and below respectively each of which recesses 59, 60 is laterally limited and partly closed by a stop 61 and 62 respectively aligned with the respective bottom of the respective insertion parts 49, 50.

The power outlet insert 40, the front 39 and the other housing parts of the adapter 2 may be made from plastics material in one single piece, for example by using a moulding procedure. It would also be conceivable to make both housing parts together as one single unit.

Extending centrally through the power outlet insert 40 of the adapter 2 is a rotating sleeve 63 made from plastics material or metal and having an axial bore 64, a hat 65 having a flange 66 directed frontwardly and locking grooves 70, at least one of which can be seen in the drawing (FIG. 6) located at some distance from the head 65. A front locking ring 72 and a rear locking ring 71 may be inserted, into the locking grooves 70. The bottom of the power outlet insert 40 is located between the front locking ring 72 and the head of the rotating sleeve 63 and, behind the locking ring 72 a further ground contact 100 is mounted.

The rear end of the rotating sleeve 63 is slotted to form fork legs 73, 74 with respective inwardly directed claws 76, 77 and a fork opening 75. The rear end of the rotating sleeve carries a transversely orientated contact beam 78 made from electrically insulating material, preferably a plastics material. The contact beam 78 has a shape of a parallelepiped having a central bore 79 extending throughout the contact beam and openings 80, 81 in the neighborhood of the bore 79 for reception of the fork legs 73, 74. The openings 80, 81 are adapted to the profile of the end of the rotating sleeve 63, including the claws 76, 77 so that these parts can be inserted into the contact beam 78 and a cover plate 82 can be retained at the rear side of the contact beam by means of the claws 76, 77. The cover plate 82 thus holds all the parts in their correct position.

The contact beam 78 incorporates a U-shape contact bridge 84 intended for use as an earth conductor and having legs 85, 86 and a bridge 87. The legs of the contact bridge 84 can be inserted from the rear side of the contact beam into same, the upper leg 85 being pushed into a suitable slot 88 and the lower leg 86 being pushed into an opening 89, which is larger than the upper slot 88, and into which further contact legs can be located for use as electrical conductors. At the other side of the contact beam 78 there is a lower phase scale and a lower phase selector opening for the purpose of easy selection of the phase, as will be described below.

Similarly, above the bore 79 and the openings 80, 81 the contact beam 78 has an upper slot 91 for reception of a phase contact, and there above a larger opening 92 with an upper phase scale 93 for the purpose of phase selection. The slot 91 is designed to receive, as phase contact, one leg of an angle-shaped contact metal sheet 94, the other leg 96 of which has lateral bordered flanges intended to receive a leg 99 of an angled phase selector 97 the other leg 98 of which extends into the opening 92. The phase selector 97 has notches in the legs 98, which notches can be seen from the drawings, and whereby the legs 99 may be widened.

The rotating sleeve 63 also carries a ground contact 100 comprising an earthing contact 101 and a bore 102. The earthing contact 101 is U-shaped and extends forwardly into the power outlet insert 40. In the illustrated example, the earthing contact 101 is lying in a vertical plane. Its lower leg leads to a contact conductor 103 directed towards the rear side of the adapter 2. The free ends of the contact conductor 103 form earth contacts 104, 105 which are intended to extend out from the rear free end of the insertion parts 49, 50 and to make contact with the earth conductor 24 (FIG. 2).

Although the insertion parts 49, 50 are substantially identical the earth contact 104 extending out from at least one of the said parts in combination with the asymmetrical mounted groove 21 (FIG. 2) and the earth contact 24 ensures that the adapter 2 can only be inserted into the current rail 1 in one particular orientation, which is preselected by the phase selection. Thus, wrong or dangerous connections are completely excluded. In the wrong orientation it is impossible to misadjust the adapter and the contact beam is in an unactivated position.

Pin sleeve sockets 106, 107 extend from the power outlet insert 40 to the rear side of the adapter for combination with pin sleeves 108, 109 into which the pins of a power plug may be inserted. The pin sleeve 108, shown in the drawing at the left side, is connected to a holding part 110 extending to the rear side, and the pin sleeve 109, shown in the drawing at the right side, is combined with a holding part 111 extending to the rear side. The holding part 110 is adapted to receive the upper leg 85 of the contact bridge 84 whereas the holding part 111 is adapted to receive the lower contact plate 43 of the fuse. The upper contact plate 44 of the fuse will be inserted into a holding part 113, the latter being part of an angle-shaped connecting part 112, the other holding part 114 of which is directed to the rear side of the adapter 2 and is adapted to receive the contact plate 95 extending through the slot 91.

When the phase legs 85, 95 are inserted into the holding parts 110, 114 they are fixed in the adapter 2, the insertion parts 49, 50 of which are provided at the base with locking legs 115, 116 (FIG. 6) which extend towards each other like claws, so that the bores are locked against unintended lateral shifting. Each of the insertion parts 49, 50, of course, has an opening 117 in the region of its recess 59, 60, which opening 117 is provided for the said holders or the said legs, and also has a cut-out 118 for the rotating sleeve 63.

The configuration of the adapter 2 when mounted can be seen from the remaining figures of the drawings. When the contact beam 78 is pushed outward it can be turned into the insertion parts 49, 50 (FIGS. 4, 7, 8) so as to rest against the stops 61, 62 and thus be prevented from further clockwise turning looking from the front towards the adapter as in FIG. 1. In this position the contact beam 78 is also located in some distance from the bottom of the recess 59, 60, which space is intended to receive the legs 85, 86, 95 and 98, as flat contacts extending away from the contact beam 78.

When the adapter 2 is to be electrically connected to the current rail 1 the insertion part 49, 50 is pushed through the opening 11, the walls 9, 10 of which are a close fit around the insertion parts 49, 50 and thereby guide the same effectively, into the current rail 1 until the flat contacts 104, 105 (FIG. 4) are inserted into the earth connector 24 (FIG. 2). The insertion parts 49, 50, may at the same time, rest against the rear wall 4 of the current rail, which rear wall 4 acts as a stop. In this condition the housing halves or parts 47, 48 may rest against the front walls 7, 8 of the current rail.

The phase selection should be made prior to insertion of the adapter 2 by moving the leg 98 to the desired position on the scale 93. Later, the rotational sleeve 63 is turned by means of a suitable tool which meshes or engages grooves 67 in the rotation sleeve 63. Said sleeve 63 must be turned through one quarter of a revolution in a counterclockwise direction (viewed from the front of the adapter) so that the contact beam 78 aligns perpendicular to the insertion part 49, 50, its opposite surfaces resting against the stops 61, 62. In this position, which is not shown in any of the figures of the drawings, there is still a space between the contact beam 78 and the respective bottom of the recess 59, 60, and except the flat contact 104, 105, no contact legs or flat contacts are in electrical contact with any of the conductors connected with the phase. After this, a suitable rotating tool, for example a screwdriver, is brought into the widening 68 and engaged with the screw 69 to turn it clockwise through a predetermined angle. By means of the threaded engagement of the screw 69 in the sleeve 63, the contact beam 78 is drawn towards the bottom of the recesses 59, 60 until it rests against the bottom or is in close proximity thereto so that the legs 85, 86, flat contacts 95 and legs 98 are inserted into the predetermined contact openings and phase conductors as shown in FIG. 2. By this action the contact beam is eventually drawn into one of the cuts (FIG. 5) in connection with the recesses 59, 60, so that it can no longer be pivoted in its contact position, because the lateral surfaces of the cut abut the longitudinal sidewalls of the contact beam 78. As can be seen from FIG. 5 of the drawings, the contact beam 78 slides on the fork legs 73, 74 (FIG. 6) from its initial pivoted position to its contact position when the screw 69 is turned. It is now possible to connect suitable electrical apparatus via the power outlet, the switch 42 incorporating the fuse can be operated and said electrical apparatus can be switched on.

In principal it is possible to move the adapter along the current rail in its activated position. However, such movement is not desirable because a minimum contact pressure between the interengaged parts is necessary to guarantee a good electric contact and frequent movement would tend to reduce said pressure.

The adapter 2 can be removed or disconnected from the rail by the converse sequence of operations, the screw 69 firstly being turned counterclockwise so that the contact beam 78 between the fork legs 73, 74 is pushed towards the rear of the adapter 2 and finally rests at the claws 76, 77. After that, the rotation sleeve 63 is turned counterclockwise by a quarter rotation so that the contact beam returns to the position shown in FIG. 4, whence the adapter 2 can easily be drawn out from the current rail 1.

Figure 6:
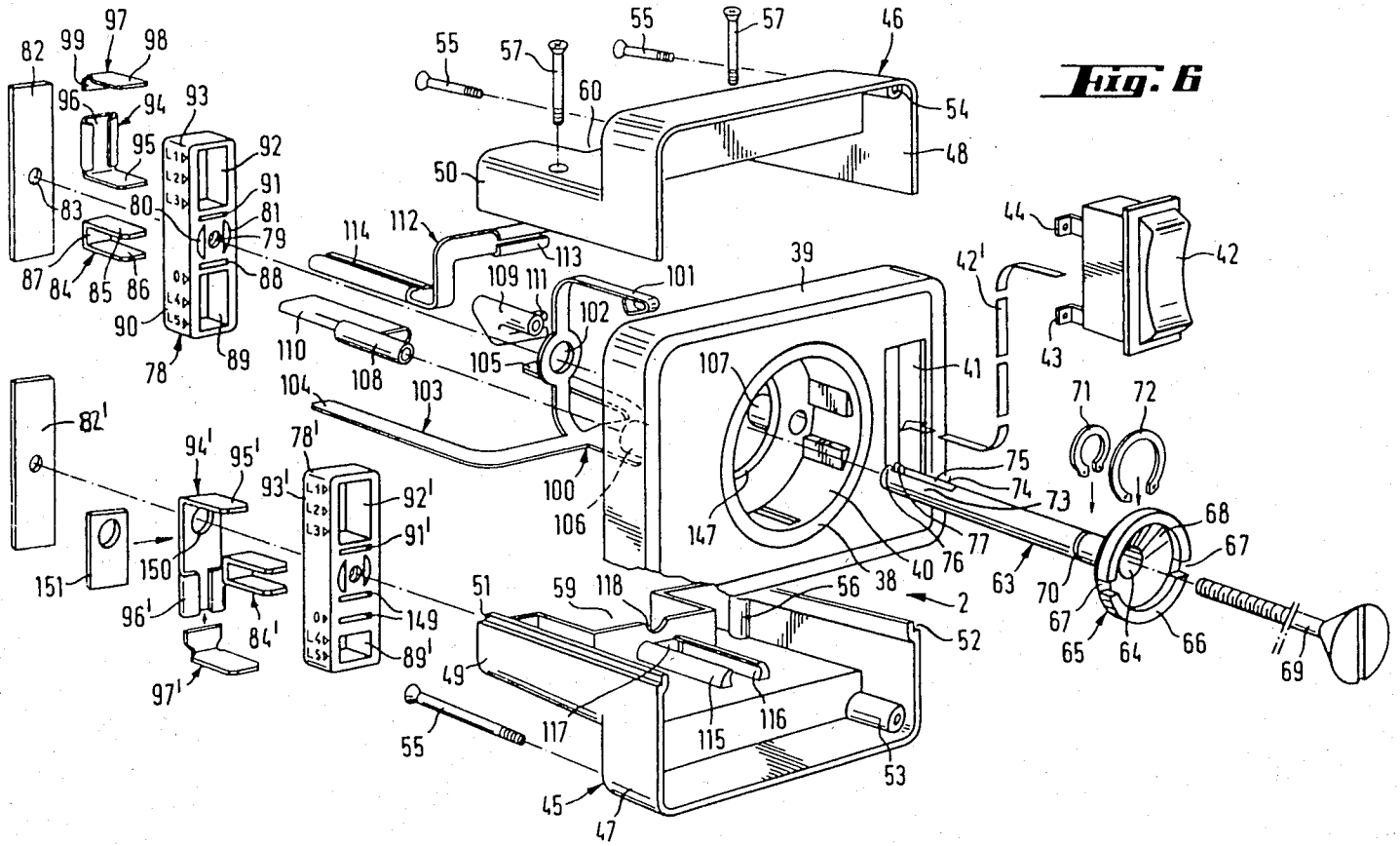
FIG. 6 is a perspective exploded view of the adapter shown in FIG. 5 but from the front.

The drawings mainly show a phase selection between the free upper phases (upper left hand side of FIG. 6). However, a two-phase-system can also be accomplished. To this end, lower leg 86 of the earth contact bridge 84' may be pushed through a slot 149. A contact sheet 94' has its flat contact 95' extending through a slot 91' and its holding leg 96' bent down and having a bore 150 through which the rotating sleeve extends. At the end of the holding leg 96' are bordered flanges holding a phase selector 97' at a level of the lower opening 89' for the phase selection. An earth contact sheet 82' and the contact 94' should be divided from each other by means of an insulating strip 151 which also has a bore for the rotating sleeve 63. Thus, phase selection does not raise any problem and can be easily accomplished. Of course, it is also conceivable that just one single contact metal sheet could be used for all phases. However, this is more for reasons of safety than for technical reasons and also depends on legal provisions.

Figure 3:
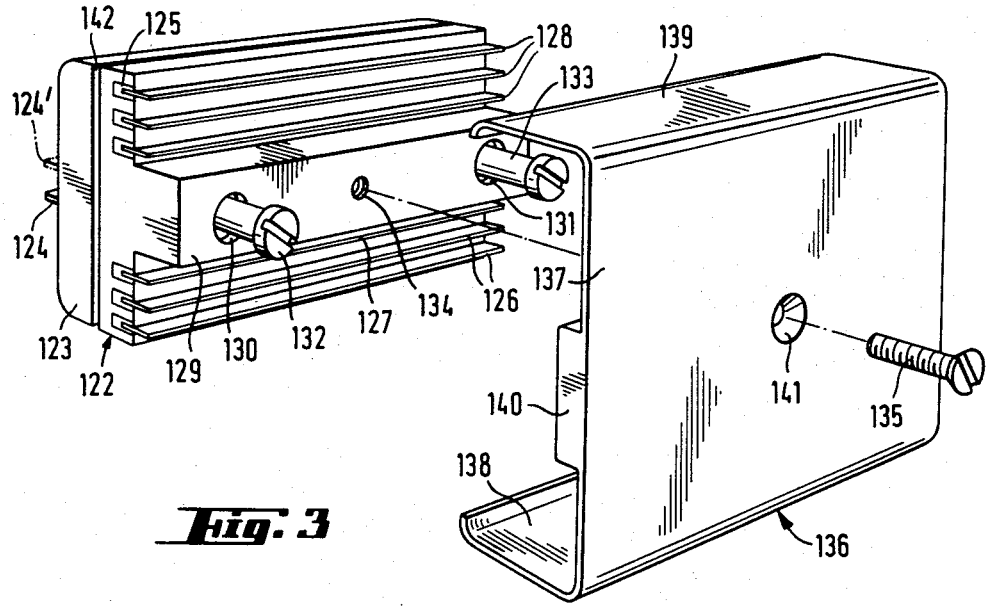
FIG. 3 is a perspective exploded view of a jointing device for connecting conductors of current rail extensions.

Sections or lengths of the current rail 1 may be easily joined together, as will be described in relation to FIG. 3 of the drawings, e.g. when an extension of the current rail is required. FIG. 3 shows a jointing device 122 having a rear tension block 123 and a frontal tension block 125. These two blocks 123, 125 rest against each other (which is not dangerous) and fill spaces 16 of adjacent current rail sections or segments. To mount said blocks 123, 125 they are moved laterally into the space 16 such that an earth ledge 124 in a similar manner to the flat contacts 104, 105 is inserted into the earth conductor 24 of the adjacent current rail. The earth ledge 124 is located at the rear side of the rear tension block 123 and lower and upper conductor ledges 126, 127, 128 are provided along the front side of the front tension block 125, these ledges being adapted to come into contact with the phase and earth contacts in the current rails. Furthermore on the front surface of the front tension block 125 there is a guiding ledge 129, the height of which is selected to fit into the opening 11 in the current rail and which has bores 130, 131 through which threads for tightening screws 132, 133 extend. Such tightening screws may be rotated with their free ends. However, they are supported by the rear tension block 123 and cannot be entirely removed. The thread of the screws co-operates with the threaded bores 130, 131, so as to draw the tension blocks tightly together for insertion into the spaces 16 and also to later push them apart to firmly fit into said spaces 16. In this way current rail segments can be connected together or disconnected in a quick and easy manner. The earth ledges 124 and 127 and the conductor ledges 126, 128 are made from electrical conducting material, whereas the tension blocks 123, 125 are made from electrical insulating material.

The resultant joint between the two current rail segments is protected by means of a U-shaped cover plate 136 consisting of a bridge 137 and legs 138, 139, the ends of the legs being bent, as can be seen from FIG. 3, so that there is a snap-in effect and a safe connection can be achieved. An additional holding means for the cover plate 136 is provided by a threaded bore 134 in the guiding ledge 129 into which bore a screw 135 may be inserted. The cover plate 136 has a recess 141 for the screw head. The bridge 137 of the cover plate 136 can be stiffened by use of a rib 140, which aids guidance when the jointing device is inserted into the current rail's opening 11. A slot 142 between the two tension blocks 123, 125 permits ventilation between adjacent parts. In another embodiment it would be possible to provide sponge rubber between the tension blocks in order to take up any changes in length of the adjacent current rails.

The rail is connected to the power supply by means of suitable end pieces, where, for example, the phases of the electric cable may be connected to the respective conductors of the current rail.

Within the angle piece 120 (FIG. 1) there are suitable cables or wires, which can be bent or lengthened so as to accommodate changes in the distance between the adjacent jointing devices. The angle piece 120 is protected by a concertinalike covering 120 and may be bent up to 180°.

The above-mentioned phase selection can be accomplished manually by moving the respective legs directly, or indirectly by means of mechanisms including, for example, a control knob, a lever or the like.

Figure 4:
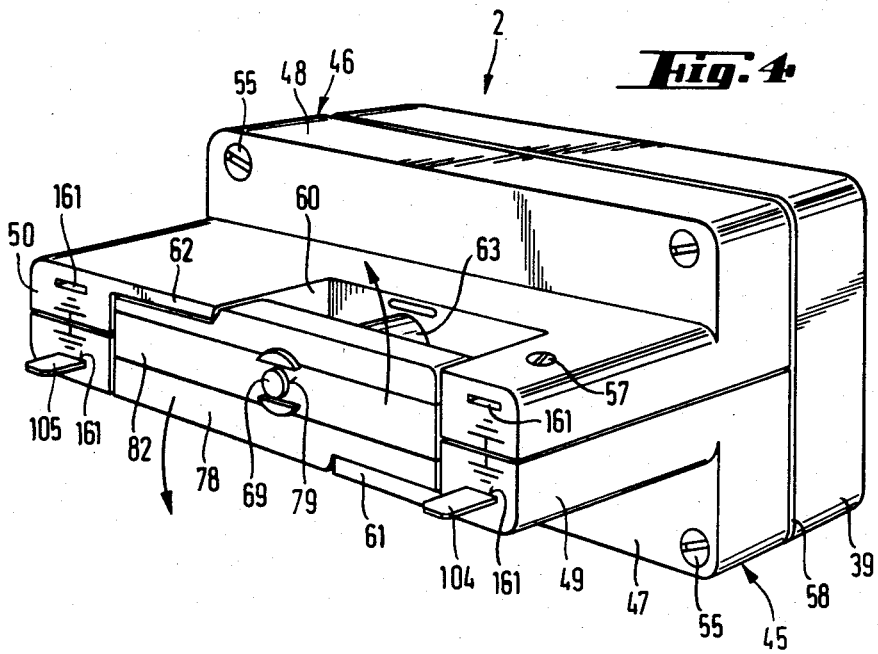
FIG. 4 is a perspective view of an adapter from the rear.
Figure 5:
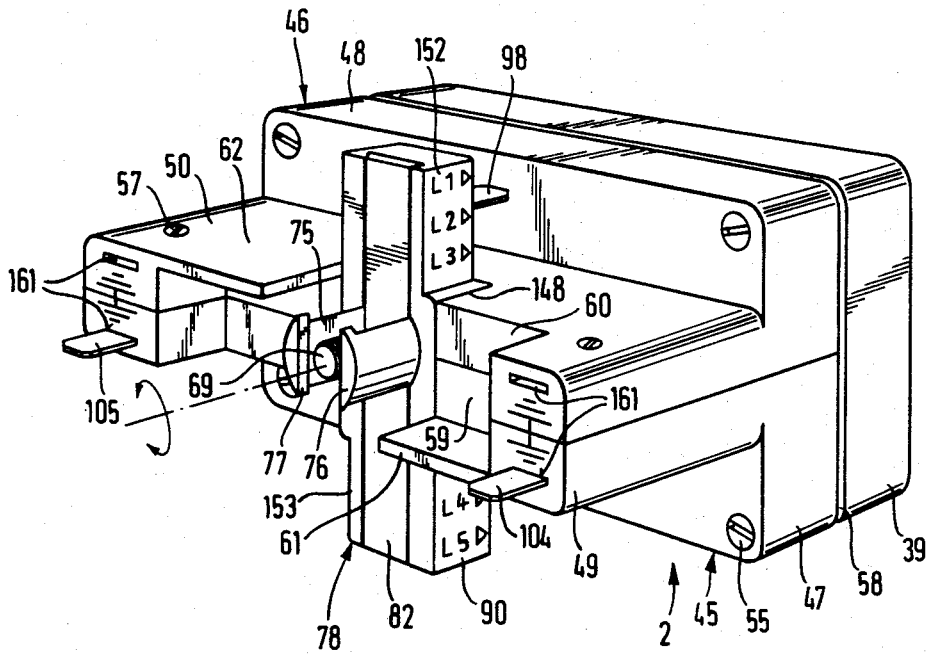
FIG. 5 is a similar perspective view of the adapter shown in FIG. 4 after power connections have been made.

In a further embodiment of the invention the contact beam 78 is provided with notches 152, 153 which may rest against stops 61, 62 of the insertion parts 49, 50 to give a rest position when the contact beam 78 is not activated (FIG. 4).

The profile of the current rail need not be symmetric. It may, for example, have an opening 11, which is limited on one side by a short wall. Moreover, the mechanisms for moving the contact beam forwards and backwards and pivoting same may be different to those described above. Also the adapter itself may be an electric apparatus for a lamp.

The flat contacts 104, 105 (FIGS. 4, 5) extend through contact slots 161, provided at the rear of the insertion parts 49, 50. As the insertion parts 49, 50 can be made from plastics material as substantially identical parts in the embodiment shown in FIGS. 2, 4 and 5 just the contact slots 161 of one of the insertion parts 49 is provided with flat contacts 104, 105, whilst the other contact slots 161 at the other insertion part 50 are blank, i.e. no flat contact extends therethrough.

Although in the above described embodiment of the adapter 2 only power supply by means of the current rail has been described, it is also possible to provide a supply in connection with TV, telephone and control wires or cables by using the current rail. Such an embodiment will be described below in connection with FIGS. 9 and 10 of the drawings.

This current rail 1''' also has a hollow C-shaped body 3 (FIG. 9) of rectangular cross-section with one of the longitudinal sides forming a rear wall 4 leading to shorter side walls 5, 6, and in turn to front walls 7, 8. The latter are bent towards the rear wall 4 and form opening walls 9, 10 defining an opening 11. If necessary, said opening 11 may be closed by a cover plate 136', the free ends of which may be snapped into the opening 11.

In this embodiment electric conductors 35, 36, 37 with their electric insulating holding parts are provided as described above in connection with FIG. 2. In contrast, however, on the current rail's rear wall 4 (FIG. 9) modified mounting profiles 17', 20' are provided for mounting a current rail on a wall. Between said profiles 17, 20 further mounting profiles 18', 19' are provided for mounting the current rail to a ceiling. In this embodiment said mounting profiles each have opposing pairs of flanges by means of which the current rail 1''' may be fixed. The inner mounting profile 18' is hollow having a groove 21 opening into the space 16 within the C-shaped body 3 of the current rail. The earth conductor 24 is retained within the groove 21 by hook profiles 22, 23. Adjacent the groove 21 in the rear wall 4 of the current rail (FIG. 9) is a somewhat broader groove 21' also provided with hook profiles 22', 23' at the transition thereof to the space 16. Said hook profiles 22', 23' retain the insulating strip 24' in the groove 21'. The insulating strip 24' is U-shaped in section having legs which resiliently rest at the side walls of the groove 21'. Thus, the insulating strip 24' can be snapped into the groove 21' to be mounted therewith the free ends of its legs behind the hook profiles 22', 23' to prevent the insulating strip 24 falling out from the groove 21'.

At the inner side of the insulating strip's 24' legs electric conductors 1', 2' are provided, serving for electrical connection with flat contacts or contact pins inserted into the groove 21'. Said conductors 1', 2' are preferably used for telephone, TV and/or control circuit purposes. In the present embodiment both of the conductors 1', 2' are staggered to each other in view of the depth of the groove. The elastical properties of the insulating strip 24' can thus be used in the best way, and a good electrical contact can be achieved.

Figure 9:
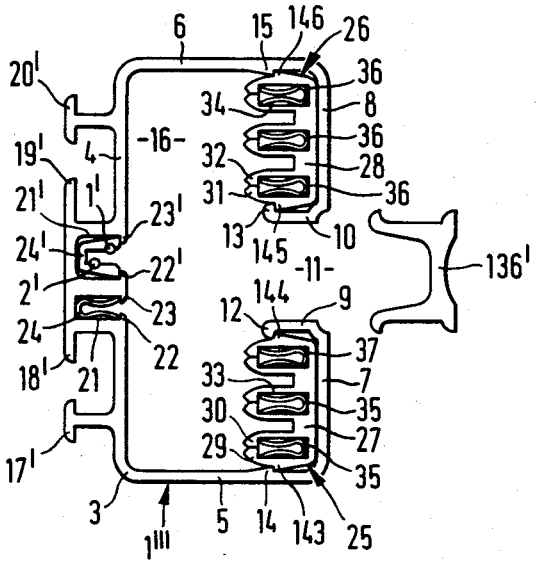
FIG. 9 is a cross-section through another embodiment of the current rail with additional contacts for communication or control connections.
Figure 10:
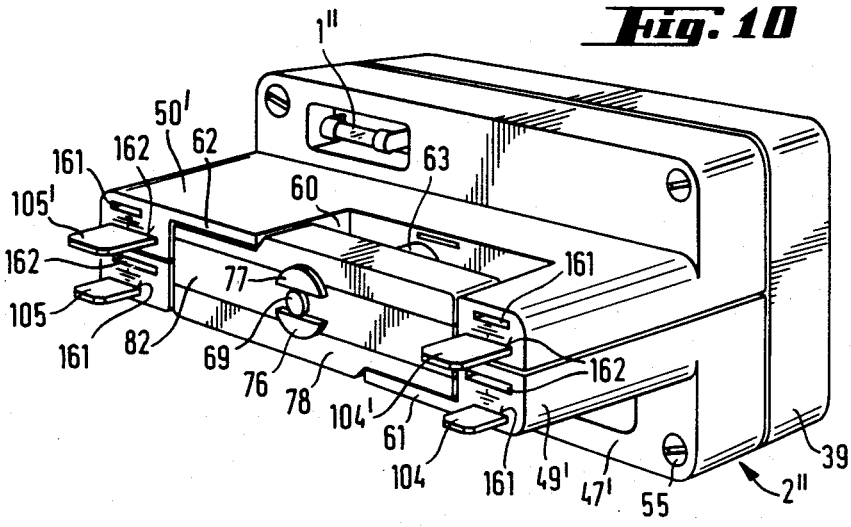
FIG. 10 is a perspective view from the rear of another embodiment of the adapter which is adapted for use in connection with the current rail shown in FIG. 9.

An adapter 2'', as shown in FIG. 10, may be used with the current rail shown in FIG. 9. This adapter 2'' is similar in design to that shown in FIGS. 4 to 8. However, in the embodiment of FIG. 10 larger contact pin slots 162 at the rear surfaces of the insertion parts 49, 50 are provided to receive larger flat contacts 104', 105'. In the embodiment shown in FIG. 10 flat contacts 104, 105 are located in contact pin slots 161 for use with the earth connector 24 (FIG. 9). Additionally flat contacts 104', 105' are located above the lower flat contacts 104, 105 and extend through contact pin slots 161 for use in contacting the electrical conductors 1' and 2'. The latter contacts belong to a TV, telephone and/or control circuit. The grooves 21 and 21' are located asymmetrically at the rear wall 4 (FIG. 9) of the current rail. Thus, the adapter 2'' (FIG. 10) can only be inserted into the current rail in one predetermined orientation, and not in a position turned by 180°.

Also, in this embodiment, the two insertion parts 49', 50' are preferably made as identical parts, so that only one mold is required to form both of the insertion parts.

A fuse 1' is mounted at the rear of the housing half or part 47' formed by the two insertion parts 49', 50' and serves to fuse apparatus which is connected to the adapter 2'' and adapted to use low voltage.

The adapter 2'' (FIG. 10) may also be used for the connection of electrical apparatus and components requiring a power supply as well as for TV, telephone and/or control circuit connections. It is also possible to use the adapter 2'' directly as part of a communication facility, for example as a visible signal, a display for letters or figures or an acoustical signal device. Alternatively, the adapter 2'' may be used as a ramp or a socket having outlets belonging to a communication system and/or control system. The adapter 2'' could, however, also be a lamp having an additional outlet being part of a communication system and/or a control system. Instead of outlets for inserting plugs for the said communication system or control system, wireless transmitters or receivers, for example infrared or supersonic sensors or antennas could be incorporated into the adapter 2''.

Thus, by using the rail according to the invention apparatus and devices can be electrically connected together from one room to the other without any switching action via central stations.

Instead of the use of the illustrated flat contacts 104, 104', 105, 105', flat contacts which form part of printed circuit boards can be used.

The conductors 1', 2' for the communication and/or a control circuit use according to the embodiment of FIG. 9 can also be used for telephone installations of any kind, optical and wireless paging systems, clock-installations, other installations for time information, check-clocks, control apparatus to control attendance, break signalling systems, gate closure apparatus, information systems, for example with displays saying "engaged/wait", fire alarm systems, fail signal sensors or control apparatus for a light system or for an air-condition control system.

Figure 11:
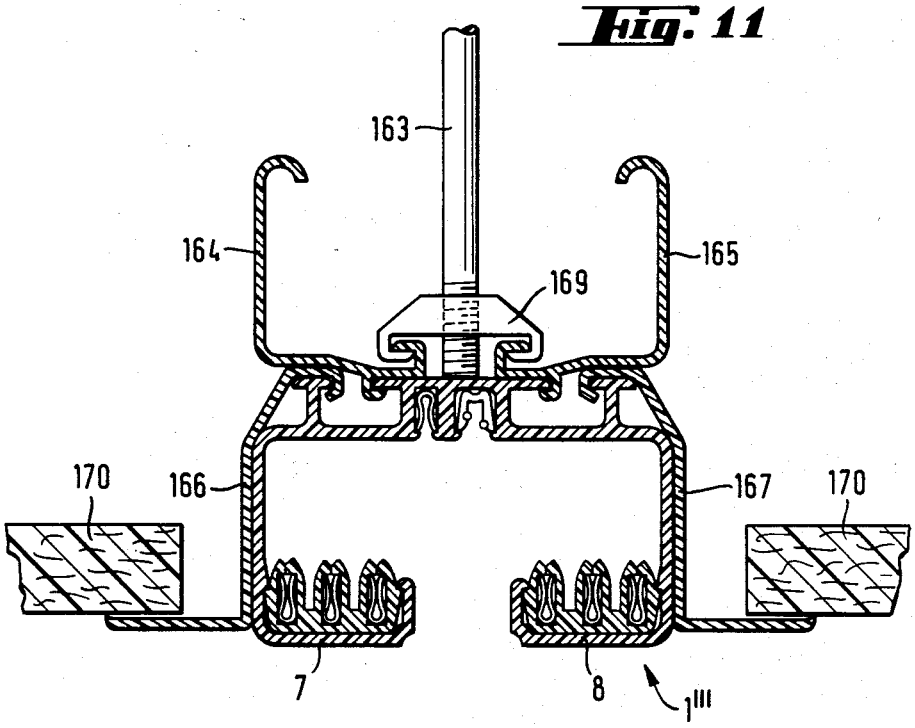
FIG. 11 is a view, partially in cross-section, of a third current rail mounted by means of a bar and having side facings.
Figure 12:
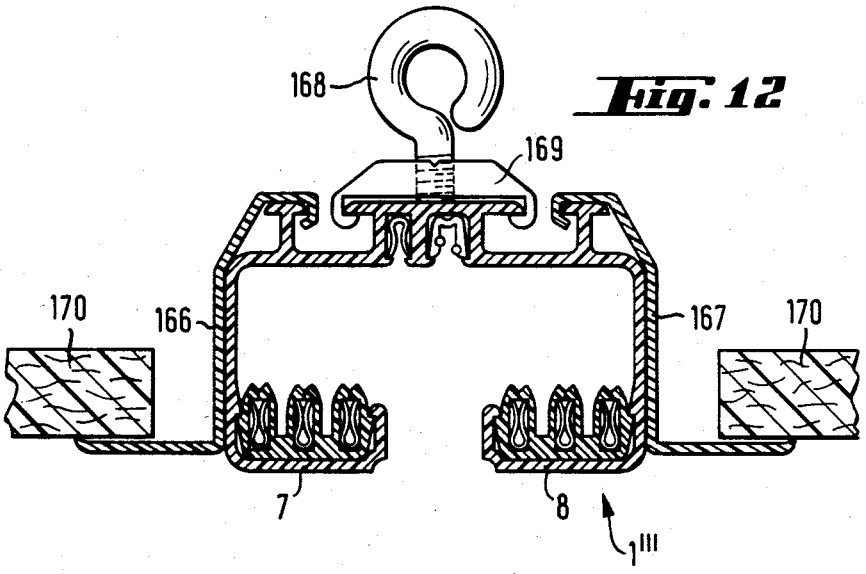
FIG. 12 is a view, partially in cross-section, of a fourth current rail with side facings and another bar having a hook configuration.

The current rail 1''' can be mounted on a ceiling structure, for example a sub-ceiling hanging under another ceiling by means of a bar 168. In another embodiment the sub-ceiling can actually be borne by the current rail. For the aforesaid system a sliding nut 169 engaging a profile of the current rail 1''' is directly fixed to the bar 168 as shown in FIG. 12. The end of the bar 168 (FIG. 12) which is directed towards the ceiling may be designed like a hook. In the embodiment shown in FIG. 11 a sliding nut 169 engaging the claw-shaped ends of profiles 164, 165, which in turn engage mounting profiles of the current rail 1''' is directly attached to a bar 163. In addition to the profiles 164, 165 (which also can be made as one single part, and which may form a cable or wiring channel) further profiles 166, 167 may be provided engaging respective profiles at the current rail 1''', which profiles 166, 167 may carry a sub-ceiling 170 or panels therefor. Moreover, penetration of material to the rear of the current rail 1''' may be avoided by using profiles 166, 167 and 164, 165 to obtain a flush closure with the sub-ceiling 170. The bar 163 (FIG. 11) or the bar 168 (FIG. 12) may also be used for wall mounting of the current rail.

The current rail 1''' may also be mounted on a ceiling by means of a hook (FIG. 12) and, with this kind of mounting, the profiles 166, 167 may also be hooked to the current rail.

Instead of the rotating sleeve 63 and the screw 69 for bringing the flat contacts (legs 85, 86, 98, 95 etc.) into contact with the fixed contacts (conductors 35, 36, earth contact 37) in the current rail 1, 1''' another mechanical system may be used, for example a snap-in system actuated by a special tool which is introduced into the power outlet insert 40 from the front side of the adapter.

The free ends of the phase conductors may be embedded in the lips of the insulating strip or may be connected with same in another manner, and they may have considerable resilience, so that the space around the conductors will be closed automatically even if the material of the insulating strip loses its resilience, for example after a given time or under certain working conditions. The conductors are preferably made from copper or from a copper-alloy.

With the jointing device 122 (FIG. 3) a communication ledge 124' can be provided on the rear tension block 123, if current rails 1''' according to the embodiment shown in FIG. 9 have conductors 1', 2' for communication and/or control system purposes.

We claim:

1. An electrical collector rail with a connectable adapter comprising a rail which is substantially C-shaped in cross-section and has a rear wall, two side walls and a front wall wherein an opening is located;

a number of conductors situated, at least partially, behind said front wall;

an adapter having an insertion part for insertion into said opening;

a contact beam attached to said adapter adjacent said insertion part;

plugs mounted on said contact beam; and screw means extending through said adapter, accessible at a side of the adapter remote from the rail and operable to pivot said contact beam within said rail and move said beam forward until said plugs contact said conductors and backwards until said plugs are out of contact with said conductors.

2. Apparatus as set forth in claim 1 further including a groove in said rear wall which opens into the interior of said rail, a U-shaped insulating strip located in said groove and having limbs with free ends which abut sidewalls of said groove in a springlike manner, and electrical conductors disposed on said limbs and intended to be brought into contact with contact plugs for communication or control purposes inserted into said grooves.

3. Apparatus as set forth in claim 1 wherein profiles are provided along said rear wall to carry holding means including a sliding nut into which a bar may be threaded for wall or ceiling mounting of said rail, to carry elements, such as a cable or wire receiver, and to hold a subceiling.

4. Apparatus as set forth in claim 1 wherein said screw means for pivoting said contact beam and for moving said contact beam backwards and forwards comprises a shaft in the form of a sleeve having one forked and the other end accessible at the front of the adapter and provided with turning means, and a screw extending through said sleeve and having a head accessible at the front of the adapter and a threaded part, said contact beam having a pair of openings corresponding in shape to the forked ends of the sleeve whereby said beam is slideably but non-pivotably mounted on said sleeve end and a threaded bore receiving said threaded part of said screw so that rotation of said sleeve only causes pivoting of said beam while rotation of said screw only causes movement of said contact beam forwards and backwards in relation to the conductors behind the front wall of the rail.

5. Apparatus as set forth in claim 1 wherein said contact beam is made of electrically insulating material, has the shape of a parallelepiped and has a first opening in the shape of a transverse slot for housing a stationary plug, and a second opening in the shape of a recess extending in the longitudinal direction of the beam to house an additional plug which is movable in the longitudinal direction of the beam and forms a phase selector.

6. Apparatus set forth in claim 1 wherein an opening wall extends backwards from said opening towards the rear wall of said rail and terminates in a hook-shaped profile turned towards the respective side wall of said rail and wherein said side wall has an inner surface carrying a corresponding hook-shaped profile, said conductors being retained behind front wall by said hook-shaped profiles.

7. Apparatus as set forth in claim 6 further including a plastic insulating strip having outwardly projecting shoulders which snap in behind said hook-shaped profiles and having a base abutting the inside of the front wall of said rail and lips arranged in pairs extending from the base towards said rear wall, a channel being formed between each of the lips for housing said conductors which consist of U-shaped clamping strips having inwardly curved limbs for reception therebetween of said plugs.

8. Apparatus as set forth in claim 1 further including mounting profiles permitting wall mounting of said rail extending from the rear wall of said rail, mounting profiles permitting ceiling mounting of the rail extending from the rear wall of said rail at locations between said wall-mounting profiles, one of said ceiling mounting profiles having a groove opening into the interior of said rail via hook-shaped profiles, and an earth conductor in thereform of a U-shaped clamping strip disposed in said groove.

9. Apparatus as set forth in claim 8 further including a groove in said rear wall which opens into the interior of said rail by way of hook-shaped profiles, a U-shaped insulating strip retained in said groove by said profile and having limbs with free ends abutting sidewalls of said groove, and electrical conductors disposed on said limbs and intended to be brought into contact with contact plugs for communication or control purposes inserted into said grooves.

10. Apparatus as set forth in claim 9 and further including a jointing device comprising a rear tension block and a frontal tension block, which are intended when abutting each other to fill the interior of adjacent collector rail ends, which may be slid together over the jointing device, an earth ledge disposed along the rear side of said rear tension block for insertion into and connection of earth conductors of said adjacent rail ends, conductor ledges disposed along the front side of said frontal tension block for insertion into and connection of conductors of said rails, a guiding ledge also disposed along the front of said frontal tension block for insertion into said rail opening, tension screws each extending through said guide ledge, having a threaded part located in one of said tension blocks and being turnable, but not displacably, located in the other tension block, so that turning said screws in one direction will bring said blocks away from each other and turning in the other direction will bring them closer together, a communication conductor ledge disposed along the rear side of said rear tension block for insertion into and connection of communication conductors of said rails, and a cover plate surrounding the rail.

11. Apparatus as set forth in claim 10 further including an angle piece comprising an outer concertina-like covering having ends adapted for connection to respective jointing devices and conductors extending through said covering.

12. Apparatus as claimed in claim 9 wherein said adapter comprises a front part, lower and upper rear parts which are congruent, and which, when assembled, provide said insertion part, further plugs mounted on said insertion part for insertion into said earth conductor and between said communication or control contacts, said conductors and said contacts being arranged asymmetrically in relation to said opening so that said further plugs cannot be connected to any conductors when the adapter is turned the wrong way, a power outlet insert, and a fuse with a toggle switch.

13. Apparatus as set forth in claim 12 wherein a central recess opens upwards and downwards and towards the free end of said insertion part, a cavity connected to the bottom of said recess houses said contact beam in its contact position, and stop means are formed adjacent said recess to limit and control the pivoting of said contact beam both in extended and retained position.

* * * * *